US010287847B2

(12) United States Patent
Avanashiappan et al.

(10) Patent No.: US 10,287,847 B2
(45) Date of Patent: May 14, 2019

(54) DOWNHOLE SEALING APPARATUS AND METHOD

(71) Applicant: Rubberatkins Limited, Aberdeen (GB)

(72) Inventors: Vijayamirtharaj Avanashiappan, Aberdeen (GB); David Matthew Hare, Aberdeen (GB); Craig Spalding, Aberdeen (GB)

(73) Assignee: Rubberatkins Limited, Aberdeen (GB)

( * ) Notice: Subject to any disclaimer, the term of this patent is extended or adjusted under 35 U.S.C. 154(b) by 0 days.

(21) Appl. No.: 14/781,635

(22) PCT Filed: Apr. 4, 2014

(86) PCT No.: PCT/GB2014/051069
§ 371 (c)(1),
(2) Date: Oct. 1, 2015

(87) PCT Pub. No.: WO2014/162153
PCT Pub. Date: Oct. 9, 2014

(65) Prior Publication Data

US 2016/0060999 A1 Mar. 3, 2016

(30) Foreign Application Priority Data

Apr. 5, 2013 (GB) ..... 1306195.7

(51) Int. Cl.
*E21B 33/126* (2006.01)

(52) U.S. Cl.
CPC ..... *E21B 33/126* (2013.01)

(58) Field of Classification Search
CPC ..... E21B 33/126; E21B 2033/005
See application file for complete search history.

(56) References Cited

U.S. PATENT DOCUMENTS 2,743,780 A * 5/1956 Brown ..... E21B 33/12955 166/120
4,424,865 A 1/1984 Payton, Jr.
4,858,687 A 8/1989 Watson et al.
5,095,980 A 3/1992 Watson
5,246,069 A 9/1993 Glaser et al.
(Continued)

FOREIGN PATENT DOCUMENTS

EP 0259170 A2 3/1988
EP 0654581 A2 5/1995
(Continued)

OTHER PUBLICATIONS

International Search Report and Written Opinion for International Application No. PCT/GB2014/051069 dated Sep. 18, 2014.
(Continued)

*Primary Examiner* — Matthew R Buck
*Assistant Examiner* — Aaron L Lembo
(74) *Attorney, Agent, or Firm* — Carlson, Gaskey & Olds, P.C.

(57) ABSTRACT

A downhole sealing apparatus includes a cup sealing assembly defining a central bore to permit mounting on a mandrel. At least a portion of the cup sealing assembly is configured to be rotatably coupled to a mandrel. Such a downhole sealing assembly may be millable when in situ.

22 Claims, 5 Drawing Sheets

(56) References Cited

U.S. PATENT DOCUMENTS 6,557,640 B1 * 5/2003 Cook ..... E21B 17/08 166/207
6,739,392 B2 * 5/2004 Cook ..... E21B 7/208 166/207
6,892,819 B2 * 5/2005 Cook ..... B21D 39/203 166/207
7,287,584 B2 * 10/2007 Angman ..... E21B 21/10 166/177.4
7,328,742 B2 * 2/2008 Slack ..... E21B 21/10 166/202
7,552,778 B2 * 6/2009 Slack ..... E21B 21/10 166/202
7,909,109 B2 * 3/2011 Angman ..... E21B 21/10 166/133
2006/0102338 A1 * 5/2006 Angman ..... E21B 21/10 166/177.4
2006/0151182 A1 * 7/2006 Slack ..... E21B 21/10 166/387
2008/0041583 A1 * 2/2008 Angman ..... E21B 21/10 166/207
2008/0110642 A1 * 5/2008 Slack ..... E21B 21/10 166/383
2011/0303419 A1 12/2011 Maier
2016/0076324 A1 * 3/2016 Allen ..... E21B 33/1208 166/381
2016/0265302 A1 * 9/2016 Acosta ..... E21B 33/12

FOREIGN PATENT DOCUMENTS

GB 2528802 A * 2/2016 ..... E21B 33/126
WO 94/15062 A1 7/1994
WO WO 2014162153 A1 * 10/2014 ..... E21B 33/126

OTHER PUBLICATIONS

United Kingdom Search Report for Application No. GB1306195.7 dated Aug. 23, 2013.

* cited by examiner

DOWNHOLE SEALING APPARATUS AND METHOD

REFERENCE TO RELATED APPLICATIONS

This application is a United States National Phase application of PCT Application No. PCT/GB2014/051069 filed on Apr. 4, 2014, which claims priority to United Kingdom Application No. 1306195.7 filed on Apr. 5, 2013.

FIELD OF THE INVENTION

The present invention relates to a downhole sealing apparatus, and in particular to a downhole cup seal, and to a method for establishing a downhole seal.

BACKGROUND TO THE INVENTION

Seals, such as packers, are widely used in the oil and gas industry, for example in the downhole environment for providing isolation within annulus regions, such as for zonal isolation purposes, facilitating downhole operations, permitting tool actuation and the like. In many applications packers may be retrievable, in that they may be unset and withdrawn form a wellbore. In some cases, however, it may be necessary to drill or mill through set packers, for example during planned wellbore operations, for contingency purposes or the like.

SUMMARY OF THE INVENTION

Aspects of the present invention relate to a downhole sealing apparatus and to a method for establishing a downhole seal.

An aspect of the present invention relates to a downhole sealing apparatus including a cup sealing assembly defining a central bore to permit mounting on a mandrel, wherein at least a portion of the cup sealing assembly is configured to be rotatably coupled to a mandrel.

In use, the rotatable connection or coupling between at least a portion of the cup sealing assembly and a mandrel on which the assembly is mounted may assist to facilitate or permit the sealing apparatus to be millable or otherwise machined by a rotating apparatus or tool bit, when in situ. As such, aspects of the present invention may relate to a millable downhole sealing apparatus, such as a millable downhole cup sealing apparatus.

The sealing apparatus may be mounted on and secured to a mandrel, and function to provide a seal, or at least a restriction to flow, within an annulus area surrounding the mandrel, such as between the mandrel and the wall of a drilled bore, wall of a tubular member, or the like.

The sealing apparatus, for example the cup sealing assembly, may be configurable to define a first, retracted, configuration and a second, expanded, configuration. In use, the apparatus may be run into a bore in the first configuration and activated or otherwise moved from the first configuration to the second configuration to urge the cup sealing element into sealing engagement with a bore wall.

At least a portion of the cup sealing assembly may be configured to be sealingly engaged with a mandrel, such as an outer surface of a mandrel. Such an arrangement may prevent or restrict flow between the sealing apparatus and a mandrel on which said apparatus is mounted.

The sealing apparatus may include an inner sealing arrangement configured to be interposed between the sealing assembly and a mandrel. The inner sealing arrangement may include at least one inner sealing member interposed between the sealing assembly and a mandrel to provide sealing therebetween.

A portion of the cup sealing assembly may be rotatably coupled to a mandrel via a mechanical interlock therebetween. A radially extending interlock between a portion of the cup sealing assembly and a mandrel may be provided to provide a rotatable coupling therebetween. The mechanical interlock may include or be provided via one or more radially extending members, such as keys, screws, pins, dowels, bolts or the like.

The mechanical interlock may include or be provided by a threaded connection between at least a portion of the cup sealing assembly and a mandrel. For example, at least a portion of the cup sealing assembly may include a female thread portion configured to threadedly engage a male threaded portion of a mandrel.

A portion of the cup sealing assembly may define a mandrel locking profile to permit rotational locking of at least a portion of the cup sealing assembly relative to a mandrel. The mandrel locking profile may be configured or geometrically formed to engage and rotatably interlock with a complementary locking profile associated with a mandrel. Such a locking profile may be directly formed on a mandrel. Such a locking profile may be formed on a separate component, such as a gauge ring or the like which is in turn secured to the mandrel.

A portion of the cup sealing assembly may include a locking projection configured to be received within a locking slot or recess associated with a mandrel.

Alternatively, or additionally, a portion of the cup sealing assembly may include or define a locking slot or recess configured to receive a locking projection associated with a mandrel.

Interaction between a locking slot and projection on a portion of the cup sealing assembly and mandrel may facilitate rotational locking therebetween.

A locking slot may define a radially extending slot. A locking slot may extend entirely radially. A locking slot may extend both radially and circumferentially.

A locking projection may define a radially extending projection. A locking projection may extend entirely radially. A locking projection may extend both radially and circumferentially.

A portion of the cup sealing assembly may define or include a plurality of locking projections.

A portion of the cup sealing assembly may define or include a plurality of locking slots or recesses.

At least two locking projections and/or at least two locking slots may be circumferentially arranged and separated from each other on a portion of the cup sealing assembly.

At least one projection may extend radially from a circumferential surface of a portion of the cup sealing assembly.

Alternatively, or additionally, at least one slot may extend radially from a circumferential surface of a portion of the cup sealing assembly.

At least one projection may extend axially from an axially facing surface, such as an annular surface, of a portion of the cup sealing assembly.

Alternatively, or additionally, at least one slot may extend axially from an axially facing surface, such as an annular surface, of a portion of the cup sealing assembly.

The mandrel locking profile of a portion of the cup sealing assembly may define a castellated mandrel locking profile.

Such a castellated locking profile may be provided on an axial end face of a portion of the cup sealing assembly.

A portion of the cup sealing assembly may be configured to be clamped against an annular structure, such as a gauge ring, provided on a mandrel. Such clamping may include axial clamping. Such clamping may maintain engagement of a mandrel locking profile of a portion of the cup sealing assembly with a corresponding locking profile on a mandrel, such as a gauge ring of a mandrel.

The sealing apparatus may include a clamping member configured to clamp, for example axially clamp a portion of the cup sealing assembly to a mandrel, such as to a gauge ring of a mandrel. The clamping member may include a sleeve. The clamping member may extend within a portion of the cup sealing assembly. The clamping member may include a spacing can.

The cup sealing assembly may include a unitary structure. In such an arrangement said unitary structure may be rotatably coupled to a mandrel, for example via a mandrel locking profile, such as defined above.

The cup sealing assembly may include multiple components, wherein at least one component may be rotatably coupled to a mandrel, for example via a mandrel locking profile, such as defined above. In some embodiments all components of the cup sealing assembly may be rotatably coupled relative to a mandrel, either directly or indirectly.

At least two components of the cup sealing assembly may be rotatably coupled to a mandrel. At least two components may be independently rotatably coupled to a mandrel. For example, at least two components may each be rotatably coupled to a mandrel via respective mechanical interlocks, such as respective mandrel locking profiles or arrangements. For example, at least two components may each be directly rotatably coupled to a mandrel.

One component of the cup sealing assembly may be rotatably coupled to a mandrel via another or separate component of the cup sealing assembly.

The cup sealing assembly may include at least first and second components.

In one embodiment at least the first and second components may be rotatably coupled to a mandrel via respective mechanical interlocks, such as respective mandrel locking profiles or arrangements.

In one embodiment a first component of the cup sealing assembly may be rotatably coupled to a mandrel, for example via a mechanical interlock, such as a mandrel locking profile, such as described above, and a second component of the cup sealing assembly may be rotatably coupled to the first component. As such, the second component may be indirectly rotatably coupled to the mandrel via the first component.

The sealing apparatus may include a mechanical interlock between the first and second components to provide a rotatable coupling therebetween.

The sealing apparatus may include a radially extending interlock between the first and second components to provide a rotatable coupling therebetween.

The mechanical interlock may include or be provided via one or more radially extending members, such as keys, screws, pins, dowels, bolts or the like.

The mechanical interlock may include or be provided by a threaded connection.

First and second separate components of the cup sealing assembly may be rotatably secured to each other via complementary locking profiles.

The complementary locking profiles of the first and second components may be geometrically formed to be rotatably interlocked relative to each other.

One of the first and second components may include a locking projection, and the other of the first and second components may include or define a locking slot or recess to receive the locking projection. Interaction between the locking slot and projection may facilitate rotational locking between the first and second components.

The locking slot may define a radially extending slot. The locking projection may define a radially extending projection.

At least one and in some embodiments both of the locking slot and projection may extend entirely radially.

At least one and in some embodiments both of the locking slot and projection may extend both radially and circumferentially.

One of the first and second components may define or include a plurality of locking projections. Such a plurality of locking projections may be received within a single locking slot.

One of the first and second components may include a plurality of locking projections, and the other of the first and second components may include or define a plurality of locking slots, wherein each slot may be configured to receive at least one projection. In one embodiment each slot may be configured to receive a single projection.

At least two locking projections may be axially separated from each other.

At least two locking slots may be axially separated from each other.

At least two locking projections may be circumferentially separated from each other.

At least two locking slots may be circumferentially separated from each other.

In one embodiment at least one of the first and second components may include a circumferential array of locking projections, and the other of the first and second components may include a corresponding circumferential array of locking slots or recesses for receiving respective locking projections.

In one embodiment at least one of the first and second components may include a plurality of axially spaced circumferential arrays of locking projections. In such an arrangement the other of the first and second components may include a single circumferential array of locking slots or recesses, where each locking slot is configured to receive a plurality of locking projections. In an alternative embodiment the other of the first and second components may include a plurality of circumferential arrays of locking slots or recesses, wherein each slot is configured to receive one or more projections.

At least one projection may extend radially from a circumferential surface of one of the first and second components. At least one slot may extend radially from an opposing or facing circumferential surface of the other of the first and second components.

At least one projection may extend axially from an axially facing surface, such as an annular surface, of one of the first and second components. At least one slot may extend axially from an opposing axially facing surface, such as an opposing annular surface, of the other of the first and second components.

The complementary locking profiles may define complimentary castellated seal locking profiles.

A first component of the cup sealing assembly may define or include a seal support member, such as a base ring. The seal support member may define a central bore to permit mounting on a mandrel.

A second component of the cup sealing assembly may define or include a cup sealing element mounted relative to the seal support member. The cup sealing element may define a central bore to accommodate a mandrel therethrough.

The seal support member may be configured to be sealingly engaged with a mandrel, such as an outer surface of a mandrel. Such an arrangement may prevent or restrict flow between the sealing apparatus and a mandrel on which said apparatus is mounted.

The sealing apparatus may include an inner sealing arrangement configured to be interposed between the seal support member and a mandrel. The inner sealing arrangement may include at least one inner sealing member interposed between the seal support member and a mandrel to provide sealing therebetween.

The inner sealing arrangement may be at least partially defined by the cup sealing element, such as by an integral part of the cup sealing element.

Alternatively, or additionally, the inner sealing arrangement may be provided separately from the cup sealing element. The inner sealing arrangement may include an o-ring, or the like. The inner sealing arrangement may be swellable.

The seal support member may define a sealing groove, such as an annular groove, configured to accommodate an inner sealing arrangement or a portion thereof.

The seal support member may be rotatably coupled to a mandrel, for example via a mechanical interlock, such as via a mandrel locking profile, threaded connection, screws, bolts, pins, dowels or the like, such as described above.

The cup sealing element and the seal support member may be rotatably secured to each other via a mechanical interlock, such as via complementary locking profiles, such as defined above, to permit the cup sealing element to be rotatably fixed to the seal support member.

The cup sealing element may extend axially from the seal support member. One axial end region, which may be defined as a base or proximal end region, of the cup sealing element may be mounted on the seal support member. An opposite axial end region, which may be defined as a distal or free end region, of the cup sealing element may extend axially from the seal support member. In such an arrangement at least the distal or free end region of the cup sealing element may be radially expandable to facilitate sealing, or at least a restriction to flow. Such radial expansion may be achieved by fluid flow and/or pressure.

In one embodiment the cup sealing element may extend in an axial direction from the base ring which opposes an operational or in situ flow direction. Such an arrangement may permit a flow to act on the cup sealing element and radially extend at least the distal or free end region of the cup sealing element.

The proximal end region of the cup sealing element may include or define a locking profile configured to cooperate with a corresponding locking profile of the seal support member.

In some embodiments the proximal end region of the cup sealing element may be mounted externally of the seal support member.

The proximal end region of the cup sealing element may be mounted within the seal support member, for example within the central bore of the seal support member. In such an arrangement at least a portion of the seal support member may circumscribe a region, such as the proximal end region, of the cup sealing element.

At least a portion of the seal support member may be radially expandable. At least a portion of the seal support member may be radially expandable by fluid pressure. Such fluid pressure may be pressure contained by the sealing apparatus on one axial side of the sealing apparatus, when the cup sealing element is expanded to provide a seal with an outer surface.

At least a portion of the seal support member may be plastically deformable, for example in a radial direction. Such plastic deformation may be achieved by fluid pressure. Such plastic deformation may permit an extended or expanded form of the seal support member to be at least partially retained following removal of an expansion force, for example following removal or reduction in pressure.

A portion of the seal support member which circumscribes the cup sealing element may be radially expandable, for example by fluid pressure contained by the sealing apparatus.

Such capability of at least a portion of the seal support member to radially expand, for example in response to fluid pressure, may permit the seal support member to provide an increased level of axial support to the cup sealing element, for example to assist in preventing extrusion of the cup sealing element when exposed to fluid pressure, specifically a fluid pressure differential.

The cup sealing element may be bonded to the seal support member. Such an arrangement may facilitate sealing between the seal support member and the cup sealing element. Furthermore, such bonding may assist the rotatable interlock between the seal support member and cup sealing element.

The seal support member may define a substantially uniform inner diameter.

The seal support member may define a non-uniform or varying inner diameter.

The seal support member may define a first central bore region and a second central bore region, wherein the first central bore region defines a larger inner diameter than the second central bore region.

The wall thickness of the seal support member in the region of the first central bore region may be thinner than the wall thickness of the seal support member in the region of the second central bore region. The outer surface of the seal support member may define a substantially uniform outer diameter. In such an arrangement, the difference in wall thickness along a length of the seal support member may define the first and second central bore regions.

The first and second central bore regions may be arranged axially adjacent each other. The first and second central bore regions may be coaxial.

The first central bore region may define a counterbore relative to the second central bore region.

The cup sealing element, for example the proximal end region of the cup sealing element, may be mounted within the first central bore region, for example only within the first central bore region.

The seal support member may define an interface profile between the first and second central bore regions. The interface profile may define a stepped profile.

The interface profile may define an annular surface, such as an axially facing annular surface.

In some embodiments the interface profile may facilitate axial clamping of the seal support member to a mandrel, such as an annular lip or structure, for example a gauge ring of a mandrel. Such axial clamping may be provided by a clamping sleeve, such as may be defined by a spacing can.

The interface profile may be engaged, for example directly engaged, by the cup sealing element, such as an axial end face, for example a proximal end face, of the cup sealing element. In such an arrangement the interface profile may axially support the cup sealing element.

The interface profile may include or define a locking profile configured to cooperate with a corresponding locking profile of the cup sealing element. In one embodiment the locking profile of the cup sealing element may be provided on an axial end face, such as a proximal end face, thereof, to cooperate with a corresponding locking profile on the interface profile.

The cup sealing element may include a lip structure, such as an annular lip structure, at a proximal end region thereof. The lip structure may extend radially inwardly. The lip structure may facilitate axial clamping of the cup sealing element to the seal support member, for example to an interface profile of the seal support member. Such axial clamping may be provided by a clamping sleeve, such as may be defined by a spacing can. Such axial clamping, for example by a clamping sleeve, may also function to clamp the seal support member to a mandrel. Such axial clamping may assist in providing a seal between the cup sealing element and the seal support member.

The second central bore region may facilitate mounting of the sealing apparatus on a mandrel. In such an arrangement the inner diameter of the second central bore region may substantially correspond to the outer diameter of a mandrel. In such an arrangement a slight degree of tolerance gap may be provided between the inner diameter of the second central bore region and the outer diameter of the mandrel. Alternatively, minimal tolerances, for example zero or less than zero tolerances may be provided. Such an arrangement may facilitate a degree of interference or push fitting of the seal support member on a mandrel.

The sealing apparatus may include an inner sealing arrangement configured to be interposed between the second central bore region of the seal support member and a mandrel. The inner sealing arrangement may include one or more sealing members, such as an o-ring or the like. The second central bore region may define a recess, such as an annular recess, for accommodating a sealing arrangement to provide sealing between the seal support member and a mandrel.

The first central bore region of the seal support member may be radially expandable, for example by fluid pressure contained by the sealing apparatus. In such an arrangement the first central bore region, in particular a wall of the seal support member defining the first central bore region may be deformed radially outwardly relative to the second central bore region. Such deformation may cause the seal support member at the first central bore region to define a substantially conical structure. Such a conical structure may be slightly curved, for example to define a slight concave or dished profile.

Such capability of the first central bore region to radially expand, for example in response to fluid pressure, may permit the seal support member to provide an increased level of axial support to the cup sealing element, for example to assist in preventing extrusion of the cup sealing element when exposed to a fluid pressure differential.

The seal support member may facilitate mounting of the sealing apparatus on a mandrel.

The sealing apparatus may include a seal back-up assembly. The seal back-up assembly may form part of the cup sealing assembly.

The seal back-up assembly may be associated with a cup sealing element of the cup sealing assembly.

The seal back-up assembly may be configured to assist in supporting the cup sealing element, and in particular to support the cup sealing element when in a sealing configuration. The seal back-up assembly may be configured to assist in preventing or mitigating extrusion of the cup sealing element when said sealing element is exposed to a pressure differential.

The seal back-up assembly may extend at least partially along an outer surface of the cup sealing element. The seal back-up assembly may extend along an outer surface of the cup sealing assembly in the region of a seal support member.

The seal back-up arrangement may be radially expandable. Such radial expansion may be achieved by expansion of the cup sealing element.

The seal back-up assembly may extend into and from a central bore of a seal support member. In such an arrangement the seal back-up arrangement may be interposed between the seal support member and the cup sealing element.

The seal back-up assembly may be rotatably secured to a seal support member. Such an arrangement may assist to permit the sealing apparatus to be milled or otherwise machined when in situ.

In some embodiments the seal back-up assembly may be rotatably secured to a seal support member via complementary rotatable interlocking profiles.

In some embodiments the seal back-up assembly may be welded, fused, bonded or the like to a seal support member.

The seal back-up assembly may include multiple layers, arranged one inside the other.

The seal back-up assembly may include a petal back-up arrangement. In such an arrangement the seal back-up assembly may include a plurality of petals arranged circumferentially relative to each other and around a cup sealing element. Multiple layers may each include petals, wherein the petals of at least two layers may be circumferentially off-set from each other. In such an arrangement individual petals of one layer may span any separation gaps between adjacent petals of another layer.

At least a portion of the seal back-up assembly may be plastically deformable, for example in a radial direction. Such plastic deformation may be achieved by fluid pressure. Such plastic deformation may permit an extended or expanded form of the seal back-up assembly to be at least partially retained following removal of an expansion force, for example following removal or reduction in pressure.

At least one component of the cup sealing assembly, such as a seal support member, seal back-up assembly or the like, may be formed of or include a millable material. At least one component of the cup sealing assembly, such as a seal support member, seal back-up assembly or the like, may include a low yield material. Such an arrangement may facilitate milling of the sealing apparatus. Further, such an arrangement may facilitate radial expansion of at least one component, or a portion thereof, of the cup sealing assembly, for example in response to fluid pressure contained by the sealing apparatus. At least one component of the cup sealing assembly may be formed of or include aluminium, cast iron or the like. At least one component of the cup sealing assembly may be formed of or include a composite material.

In some embodiments the sealing apparatus may not include any separate spring arrangement associated with the cup sealing assembly. In this respect, the sealing arrangement may not require any specific bias force to be applied to the cup sealing assembly, such as a return bias force to return the cup sealing assembly to a non-sealing configuration following use. In this respect, the lack of any separate sealing arrangement may assist in permitting the sealing apparatus to be millable.

In some embodiments the apparatus may include one or more spring arrangements, such as a garter spring or the like. The spring arrangement may be configured to bias the sealing element towards a retracted configuration. In use, the spring arrangement may urge the sealing element towards the retracted configuration until activated and/or may urge the sealing element back to the retracted configuration following use.

The spring arrangement may include a single spring element. Alternatively, the spring arrangement may include a plurality of spring elements. Where a plurality of spring elements are provided, at least two of the spring elements may be arranged circumferentially. Alternatively or additionally, where a plurality of spring elements are provided at least two of the spring elements may be arranged axially.

The spring element may be annular. The spring element may be part-annular. The spring element, or where there a plurality of spring elements at least one of the spring elements, may be interposed between the sealing element and the end ring. The spring element, or where there a plurality of spring elements at least one of the spring elements, may be integrally formed with or include part of the sealing element. Alternatively, the spring element, or where there a plurality of spring elements at least one of the spring elements, may include a separate component.

The spring arrangement may be constructed from any suitable material. In particular embodiments, the spring arrangement may include a carbon steel spring element. Beneficially, providing a carbon steel spring element may facilitate and/or assist in the milling of the sealing apparatus.

At least one component of the cup sealing assembly, such as a cup sealing element, may include a polymer.

At least one component of the cup sealing assembly, such as a cup sealing element, may include an elastomer, such as a rubber, for example nitrile, polyurethane or the like.

The sealing element may include a single or uniform material. In some embodiments the sealing element may include multiple materials.

The sealing element may include an elastomeric compound, such as a rubber compound. The sealing element may include a single or uniform elastomeric compound.

In some embodiments the sealing element may include multiple different elastomeric compounds. Such compounds may be intimately mixed, for example during manufacture, such as during moulding, prior to vulcanisation, or the like.

In some embodiments such compounds may be provided in separate layers. A degree of intimate mixing at an interface region between different layers may be provided. Alternatively, or additionally, a bond may be provided between different layers.

At least two compounds may be provided to facilitate or accommodate different operational conditions. For example, at least one compound may preferentially resist extrusion forces. At least one compound may preferentially accommodate sealing. At least one compound may preferentially resist erosion, such as during intimate contact with a bore wall, for example during deployment of the apparatus The sealing apparatus may be configured to be mounted on any suitable mandrel. The mandrel may include a tubular, such as casing, liner, drill pipe, drill collar, production tubing, a tubular tool string or the like. The mandrel may form part of the sealing apparatus.

The sealing apparatus may be configured for use in a cementing operation.

The sealing apparatus may be configured for use within a downhole cementing apparatus, such as within a cement shoe. In such an arrangement the sealing apparatus may be configured to be milled along with any adjacent cement and/or an associated cementing apparatus.

An aspect of the present invention relates to a method for establishing a downhole seal, including locating a mandrel carrying a downhole sealing apparatus within a wellbore, wherein the sealing apparatus is rotatably connected to the mandrel and establishing a seal against a wall of the wellbore.

The method may include establishing a temporary downhole seal. In such an arrangement the method may include a subsequent step of machining, for example milling, the sealing apparatus when in situ. In such an arrangement rotatably locking the sealing apparatus to the mandrel may permit milling to be achieved.

The method may include at least partially surrounding the sealing apparatus with cement.

The sealing apparatus may be provided in accordance with any other aspect. For example, the sealing apparatus may include a sealing element mounted on or relative to a seal support member. In such an arrangement the method may include deforming, for example plastically deforming, at least a portion of the seal support member, for example by fluid pressure.

An aspect of the present invention relates to a downhole sealing apparatus, including a seal support member defining a central bore to permit mounting on a mandrel and defining a mandrel locking profile to permit rotational locking relative to a mandrel and a cup sealing element mounted relative to the seal support member and defining a central bore to accommodate a mandrel therethrough.

An aspect of the present invention relates to a downhole sealing apparatus, including a seal support member defining a central bore to permit mounting on a mandrel and a cup sealing element mounted on and rotatably connected to the seal support member and defining a central bore to accommodate a mandrel therethrough.

In use, the rotatable connection between the seal support member and the cup sealing element may permit the sealing arrangement to be millable or otherwise machined by a rotating apparatus or tool bit, when in situ. That is, during a milling operation the components may remain rotatably locked relative to each other, thus permitting a milling apparatus to appropriately act on the sealing apparatus.

An aspect of the present invention relates to a downhole sealing apparatus, including a seal support member defining a central bore to permit mounting on a mandrel and a cup sealing element mounted on the seal support member and defining a central bore to accommodate a mandrel therethrough. The cup sealing element and the base ring define complementary seal locking profiles to permit the cup sealing element to be rotatably fixed to the base ring.

An aspect of the present invention relates to a downhole cementing apparatus including a tubular body and a sealing apparatus mounted on the tubular body, wherein the sealing apparatus is rotatably connected to the tubular body.

The tubular body may define one or more ports configured to permit outflow of cement from the tubular body, for example into an annulus surrounding the tubular body.

An aspect of the present invention relates to a downhole sealing apparatus, including a seal support member defining a central bore to permit mounting on a mandrel and a sealing element mounted on and rotatably connected to the seal support member and defining a central bore to accommodate a mandrel therethrough.

The sealing element may include an annular sealing element.

The sealing element may include a packer element.

The sealing element may include a cup sealing element.

The sealing apparatus may include first and second seal support members, wherein the sealing element extends between said first and second seal support members. In such an arrangement the sealing element may be rotatably secured to both the first and second seal support members.

An aspect of the present invention relates to a downhole sealing apparatus, includes a seal support member defining a central bore to permit mounting on a mandrel and defining a mandrel locking profile to permit rotational locking relative to a mandrel and a sealing element mounted on the seal support member and defining a central bore to accommodate a mandrel therethrough.

The sealing element may include a cup sealing element.

The sealing element may be rotatably fixed to the base ring, for example via an interlocking profile.

An aspect of the present invention relates to a downhole sealing apparatus, including a seal support member defining a central bore to permit mounting on a mandrel and a sealing element mounted on the seal support member and defining a central bore to accommodate a mandrel therethrough, At least a portion of the seal support member is radially expandable.

At least a portion of the seal support member may be radially expandable by fluid pressure.

At least a portion of the seal support member may be radially expandable by a fluid pressure differential defined across the sealing apparatus when in use.

At least a portion of the seal support member may be radially expandable by a fluid pressure differential which is below a maximum pressure differential which may be accommodated by the sealing apparatus.

At least a portion of the seal support member may be plastically deformable, for example in a radial direction. Such plastic deformation may permit an extended or expanded form of the seal support member to be at least partially retained following removal of an expansion force, for example following removal or reduction in pressure.

The seal support member may be provided as defined in relation to any other aspect.

It should be understood that the features defined above in accordance with any aspect of the present invention or below in relation to any specific embodiment of the invention may be utilised, either alone or in combination with any other defined feature, in any other aspect or embodiment of the invention. Features defined in relation to one aspect may be provided in combination with any other aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 2:
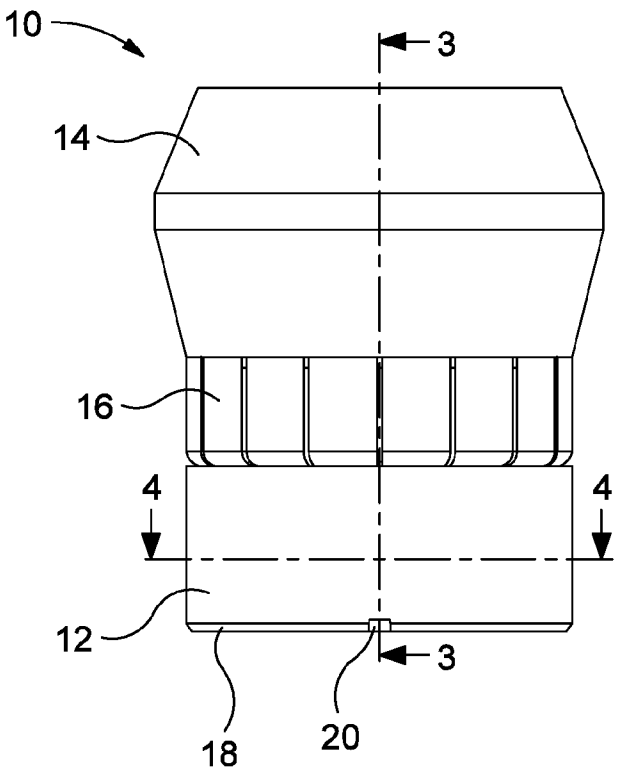
FIG. 2 is a side view of the sealing apparatus of FIG. 1.
Figure 1:
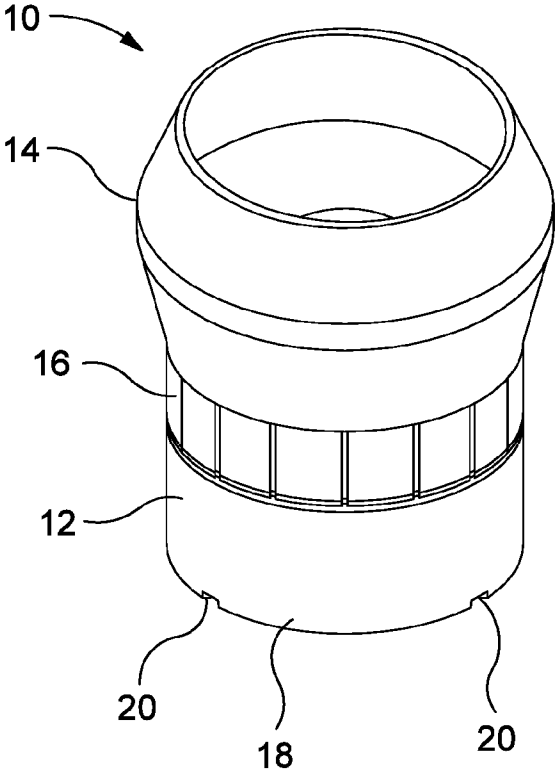
FIG. 1 is a perspective view of a sealing apparatus according to an embodiment of the present invention.

A downhole sealing apparatus according to an exemplary embodiment of the present invention is illustrated in perspective view in FIG. 1, and in side view in FIG. 2. The sealing apparatus, generally identified by reference numeral 10, includes a seal support member in the form of a base ring 12 and a cup sealing element 14 which is mounted within and extends axially from the base ring 12. The apparatus 10 further includes a seal back-up assembly 16, specifically a petal back-up assembly, which is also mounted within the base ring 12 and extends axially therefrom partially along the outer surface of the cup sealing element 14.

As will be described in detail below, the sealing apparatus 10 may be mounted on a mandrel (not shown in FIGS. 1 and 2), such as a tubular mandrel, and deployed into a wellbore to a desired location. The cup sealing element 14 may then be radially extended, for example by action of downhole fluid flow and/or pressure, to sealingly engage a bore wall, and establish a seal in an annulus defined between the mandrel and bore wall.

The lower axial end face 18 of the base ring 12 includes a plurality of radially extending slots 20 (four in the embodiment shown), circumferentially arranged (at 90 degrees relative to each other in the embodiment shown) around the axial end face 18. The slots 20 are each configured to receive a respective protrusion provided on or associated with a mandrel, to permit the sealing apparatus 10 to be rotatably locked or fixed to the mandrel. Furthermore, as will be described in further detail below, the base ring 12, cup sealing element 14 and petal back-up assembly 16 are rotatably interlocked relative to each other. Accordingly, all components of the sealing apparatus 10 may be rotatably interlocked relative to a mandrel on which the sealing apparatus 10 is mounted. Such an arrangement may permit the apparatus 10 to be milled while in situ. That is, rotatably interlocking the components of the apparatus 10 relative to a mandrel may permit a suitable milling tool to effectively act on the sealing apparatus, without individual components being simply rotated, which may otherwise render the milling tool ineffective.

The various components of the apparatus 10 may be manufactured from a readily millable material. For example, the base ring 12 and/or petal back-up assembly 16 may include aluminium or the like. Further, the cup sealing element may include a rubber material, such as nitrile, polyurethane or the like.

Furthermore, it is notable that in the present embodiment the sealing apparatus 10 does not include any spring arrangements, which are commonly used in known cup-type seals, typically used to bias the seals towards a retracted configuration. In this respect the absence of any spring arrangement may further assist in permitting the apparatus to be millable in situ. However, in some alternative embodiments (such as described below with respect to FIGS. 9 and 10) a spring arrangement may be provided.

Figure 4:
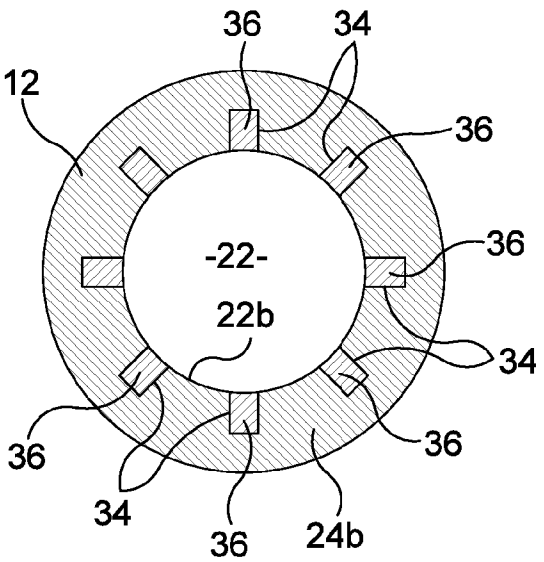
FIG. 4 is a cross-section of the sealing apparatus taken through line 4-4 in FIG. 2.
Figure 3:
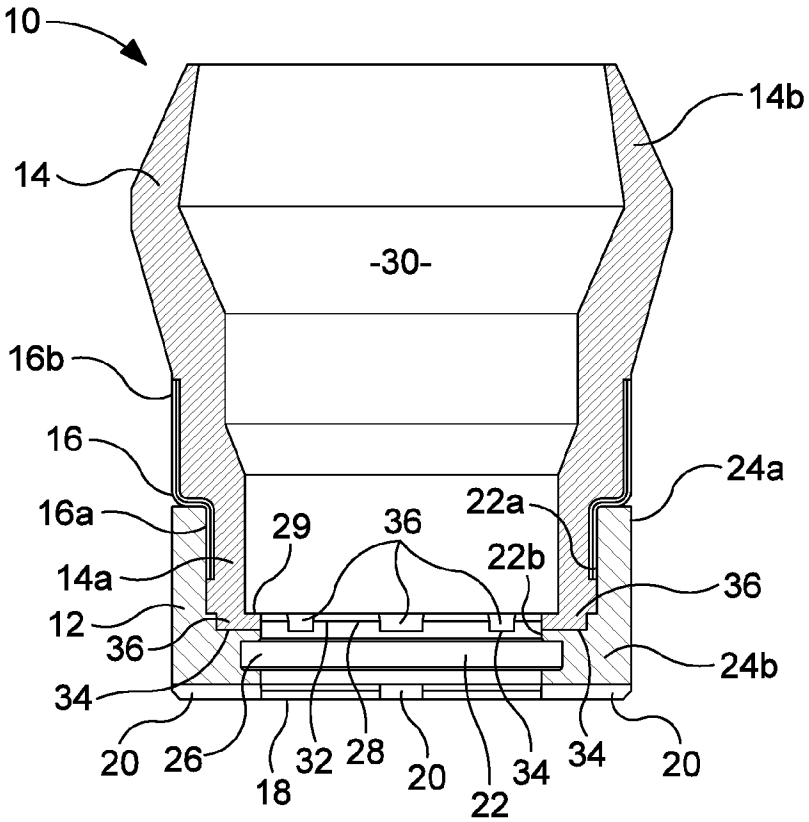
FIG. 3 is a longitudinal cross-section of the sealing apparatus taken through line 3-3 in FIG. 2.

Reference is now additionally made to FIGS. 3 and 4, wherein FIG. 3 is a longitudinal cross-sectional view of the apparatus 10 taken through line 3-3 of FIG. 2, and FIG. 4 is a lateral cross-sectional view of the apparatus taken through line 4-4 of FIG. 2.

The base ring 12 defines a central bore 22 which facilitates mounting of the apparatus 10 on a mandrel. More specifically, the base ring 12 includes a first central bore region 22*a* which is defined by a first wall portion 24*a*, and a second central bore region 22*b* of smaller inner diameter and which is defined by a second, thicker wall portion 24*b*. The second central bore region 22*b* includes an annular groove 26 which, in use, accommodates an o-ring for sealing against an outer surface of a mandrel.

The base ring 12 includes an annular surface 28 which faces generally in an axial direction and defines a stepped interface profile between the first and second central bore regions 22*a*, 22*b*.

The cup sealing element 14 defines a central bore 30 which in use accommodates a mandrel therethrough. Further, the cup sealing element 14 includes a base or proximal region 14*a* which is received within the base ring 12, and a free or distal end region 14*b* which extends axially from one side of the base ring 12. More specifically, the proximal end region 14*a* of the cup sealing element 14 is received within the first central bore region 22*a* of the base ring 12 with a proximal end face 32 of said sealing element 14 being engaged against the annular surface 28 of the base ring 12. Accordingly, the annular surface 28 of the base ring may provide axial support to the cup sealing element 14, and the first wall portion 24*a* of the base ring may provide circumferential support to the sealing element 14, specifically the proximal end region 14*a* of the sealing element 14.

The proximal end region 14*a* of the cup sealing element 14 includes a lip structure 29 which, as will be described in more detail below, may be engaged by a clamping sleeve to axially clamp the sealing apparatus 10 against a mandrel structure.

Abutting surfaces of the base ring 12 and sealing element 14 may be bonded to each other, which may assist in providing a seal therebetween.

The base ring 12 and cup sealing element 14 are rotatably coupled together via a complementary interengaging profile defined at the interface between the annular surface 28 of the base ring 12 and the proximal end face 32 of the sealing element 14. Specifically, in the embodiment shown the annular surface 28 of the base ring 12 includes a plurality of circumferentially arranged radial slots 34, and the proximal end face 32 of the sealing element 14 includes a corresponding number of radial protrusions or ribs 36 which are received within the respective slots 34.

One end region 16*a* of the petal back-up assembly 16 is interposed between the proximal end region 14*a* of the cup sealing element 14 and the first wall portion 24*a* of the base ring 12. This end region 16*a* of the petal back-up assembly 16 is also welded to the base ring 12, and thus rotatably locked to the base ring 12.

An opposite end region 16*b* of the petal back-up assembly 16 extends axially from the base ring 12 and partially along the outer surface of the cup sealing element 14. The petal back-up assembly 16 is thus configured and arranged relative to the cup sealing element 14 to provide mechanical support to said element when in a sealing configuration, and in particular to prevent or mitigate extrusion of the cup sealing element 14 when in use.

Figure 5:
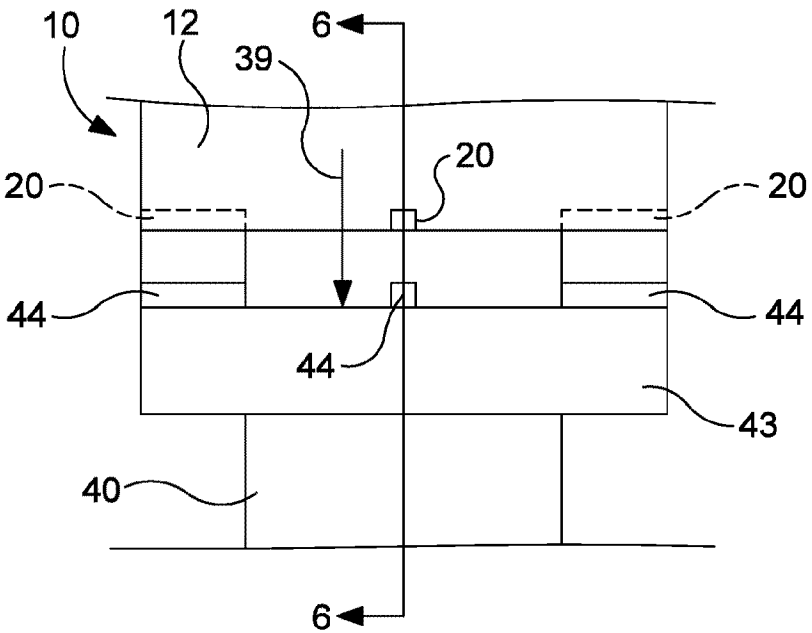
FIG. 5 is a diagrammatic illustration of the sealing apparatus being mounted on a mandrel.

Reference is now made to FIG. 5 which diagrammatically illustrates a lower portion of the sealing apparatus 10, specifically the lower portion of the base ring 12, being mounted onto a tubular mandrel 40. The apparatus 10 is slipped onto the mandrel 40, in the direction of arrow 39, towards a gauge ring 43 provided on the mandrel 40. The gauge ring 43 includes a plurality (four in the present embodiment) of circumferentially distributed radial protrusions or ribs 44 extending from the upper face thereof. Upon abutting engagement of the base ring 12 with the gauge ring 43, the ribs 44 become received within the radial slots 20 in the lower surface or the base ring 12, thus rotatably locking the sealing apparatus 10 to the mandrel 40.

Figure 6:
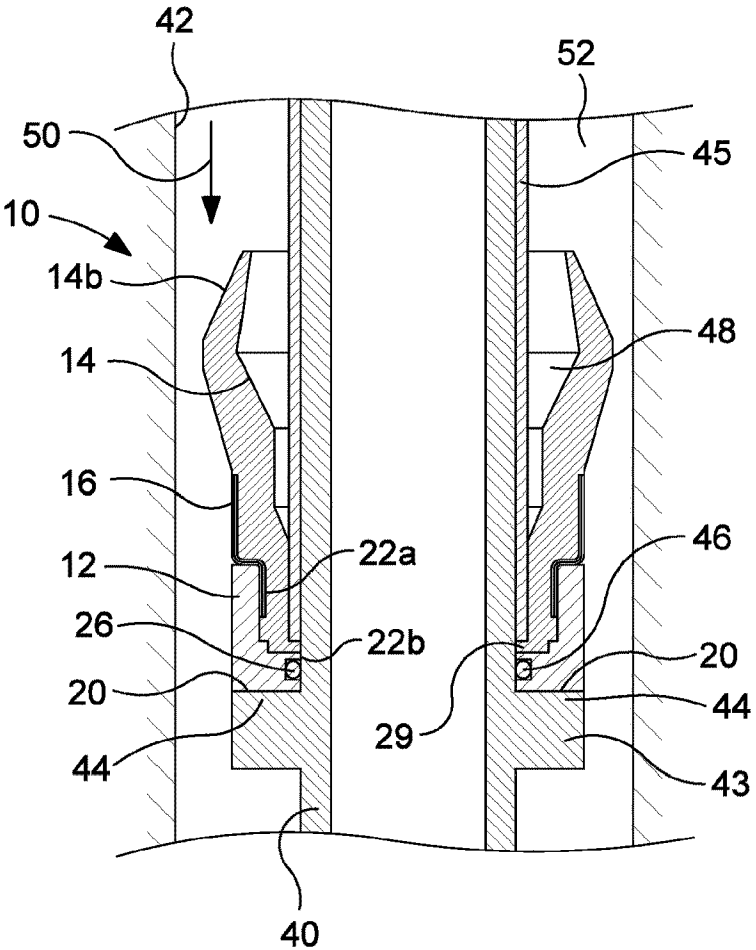
FIG. 6 is a diagrammatic illustration of the sealing apparatus (taken through line 6-6 in FIG. 5) mounted on a tubular and located within a well bore.

Reference is now made to FIG. 6 in which a sectional view of the sealing apparatus 10 is shown (taken through line 6-6 in FIG. 5), mounted on the tubular mandrel 40 and deployed into a wellbore 42, wherein the sealing apparatus 10 is shown in a first, non-sealing configuration. The wellbore 42 may be defined by a drilled bore section, or a previously lined bore section. Alternatively, the wellbore may be defined by a tubular structure, such as a production tubing structure or the like.

As described above, the sealing apparatus 10 is mounted on the mandrel 40 such that the base ring 12 axially abuts the gauge ring 43, with the protrusions or ribs 44 of the gauge ring 43 received within the radial slots 20 in the lower end face of the base ring 12.

A spacing can 45 is mounted on the mandrel 40 and presses against the lip structure 29 of the cup sealing element 14, and thus functions to axially clamp the entire apparatus 10 against the gauge ring 42. The spacing can 45 may also facilitate sealing between the sealing element 14 and the base ring 12. Although not illustrated in FIG. 6, the spacing can may be held in place and provide a clamping force via any suitable arrangement, such as via a threaded collar, connector, further sealing apparatus or the like.

When the apparatus 10 is mounted on the mandrel 40 in the manner illustrated the cup sealing element 14 defines an annular space 48 with the mandrel 40 (or spacing can 45).

An o-ring 46 is mounted within the recess 26 of the second central bore region 22*b* of the base ring 12 to facilitate sealing against the mandrel 40.

Figure 7:
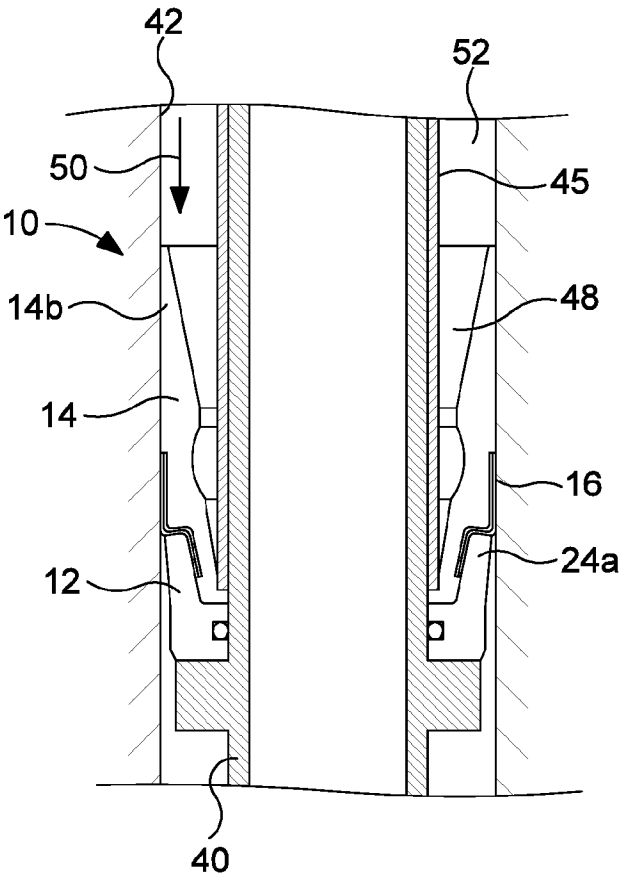
FIG. 7 is a diagrammatic illustration of a portion of the sealing apparatus in a sealing configuration.

In the embodiment shown initial activation of the sealing element 14 may be achieved by a flow of fluid in the direction of arrow 50 within annulus 52 defined between the mandrel 40 and the wall of the wellbore 42. Fluid drag will cause the distal or free end region 14*b* of the sealing element 14 to initially engage the wall of the wellbore 42, such that fluid pressure may begin to build/act in the annular space 48, eventually causing substantially the entire length of the distal end region 14*b* of the sealing element 14 to become pressed against the bore wall, thus establishing a seal in the annulus 52, as illustrated in FIG. 7, which shows a second, expanded configuration of the apparatus 10.

It should be noted, however, that in other embodiments the distal or free end region 14*b* of the sealing element 14 may define an initial outer diameter which permits engagement or interference with the wall of the bore wall even during initial deployment. In such an arrangement initial radial expansion of the sealing element 14, for example by fluid drag, to achieve initial engagement is not necessary, and pressure may directly build/act in the annular space 48.

Expansion of the sealing element 14 causes the petal back-up assembly 16 to become expanded, thus providing mechanical support to the activated sealing element 14, which may assist to minimise extrusion of the sealing element 14 along the annulus 52 by the contained pressure differential.

Also, the first wall portion 24*a* of the base ring 12 may become deformed radially outwardly by action of fluid pressure, and thus may contribute to supporting the sealing element 14 when in its sealing configuration. Such expansion of the first wall portion 24*a* may be facilitated by its wall thickness, in combination with the use of a lower yield material which is present to permit the base ring 12 to be millable.

In some embodiments the petal back-up assembly 16 and/or the base ring 12, for example the first wall portion 24*a* of the base ring 12, may be plastically deformable, such that at least a portion of the deformation may be retained following removal or reduction of fluid pressure.

The sealing apparatus may be used for any desired downhole sealing purpose. In some embodiments the sealing apparatus 10 may be used during cementing operations within the wellbore 42. For example, the sealing apparatus 10 may be configured or used to retain a volume of cement within the annulus 52 above the sealing apparatus 10 (specifically in the annulus 52 on the cup sealing element side of the apparatus 10). In such an arrangement the sealing apparatus 10 may be provided as part of or in combination with a cement assembly, such as a cement shoe assembly, which permits cement to be injected into the annulus 52 at a location above the sealing apparatus 10, for example via ports (not shown) on the mandrel 40.

Figure 8:
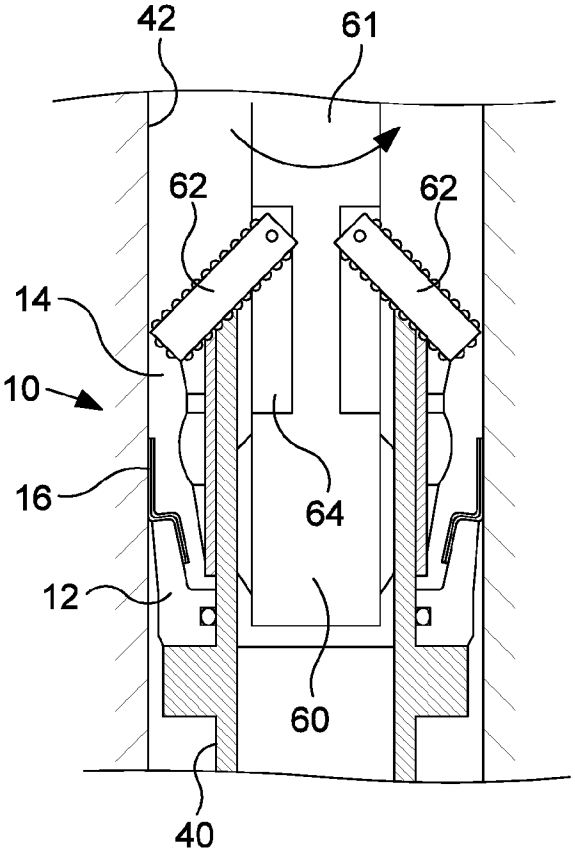
FIG. 8 is a diagrammatic illustration of the sealing apparatus being milled in situ.

In some uses it may be desirable to permanently retain the sealing apparatus 10 in place, in its sealing configuration. However, in some uses it may be desirable to remove the sealing apparatus. In this respect, as noted above, in the present embodiment the sealing apparatus 10 is specifically constructed to be millable when in situ, by permitting all components to be rotatably locked relative to the mandrel 40. An exemplary milling operation of the sealing apparatus is diagrammatically illustrated in FIG. 8, reference to which is now made.

An operator may deploy a milling apparatus 60, for example on a rotatable work string 61, through the mandrel 40 to the desired downhole location. Any suitable form of milling apparatus may be utilised. However, in the exemplary embodiment shown the milling apparatus 60 includes a plurality of radially extendable cutting members 62. The cutting members 62 may be retracted into the body 64 of the milling apparatus 60 to facilitate deployment to the desired downhole location. Once at the desired location the cutting members 62 may be extended and the apparatus 60 rotated and advanced by the work string 61, to mill the target downhole components, which may include portions of the mandrel 40, any surrounding cement and the like, along with the sealing apparatus 10.

It should be understood that the embodiments described herein are merely exemplary and that various modifications may be made thereto without departing from the scope of the invention. For example, the sealing element 14 may be independently rotatably coupled to the mandrel 40. Further, alternative rotatable coupling may be utilised, such as by use of pins, dowels, screws, bolts, threaded coupling or the like.

Figure 10:
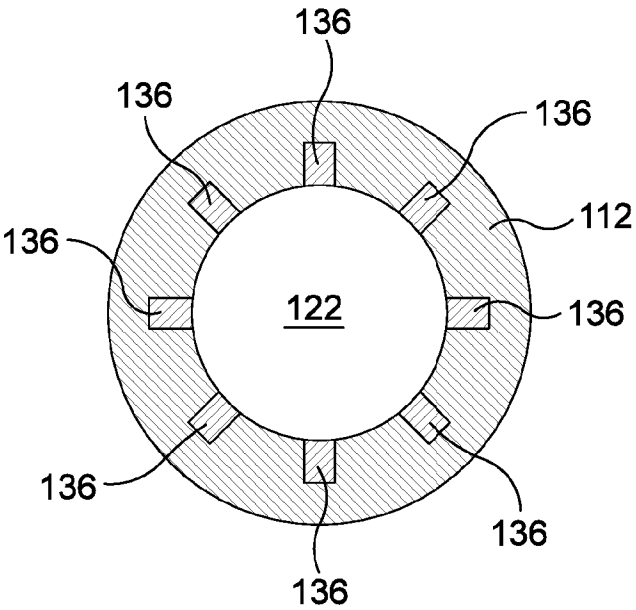
FIG. 10 is a cross-section of the sealing apparatus shown in FIG. 9.
Figure 9:
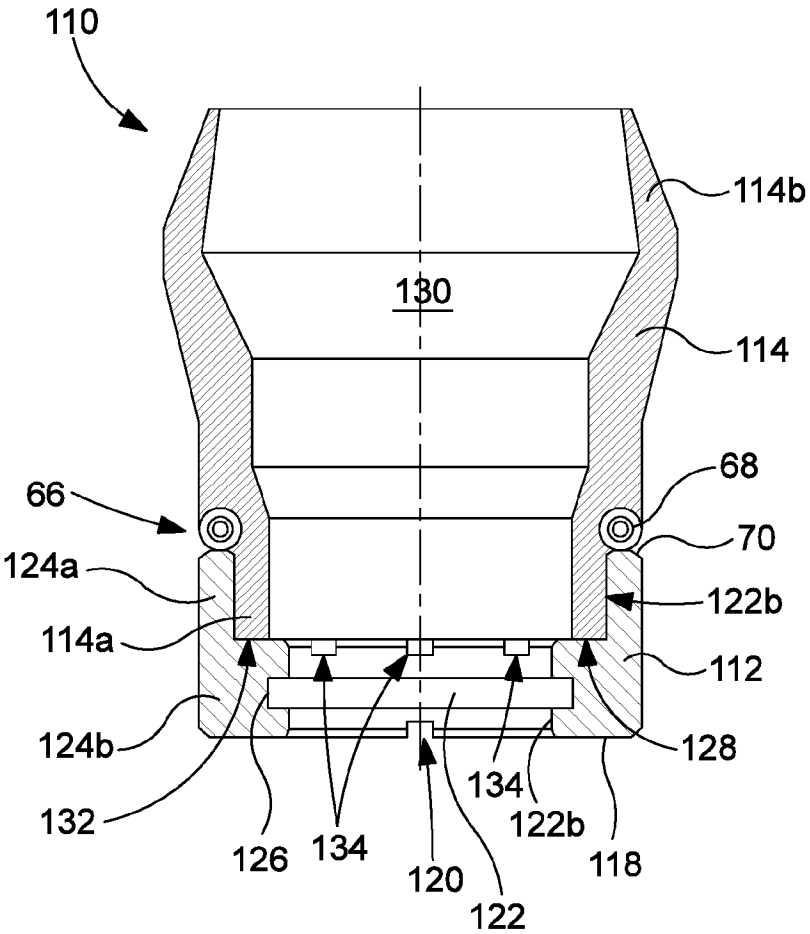
FIG. 9 is a longitudinal cross-section of the sealing apparatus according to an alternative embodiment of the present invention.

Referring to FIGS. 9 and 10, there is shown a sealing apparatus 110 according to an alternative embodiment of the present invention. The sealing apparatus 110 is similar to the sealing apparatus 10 described above and like components are represented by like numerals incremented by 100.

As shown in FIGS. 9 and 10, the sealing apparatus 110 includes a seal support member in the form of a base ring 112 and a cup sealing element 114 which is mounted within and extends axially from the base ring 112. As in the sealing apparatus 10, the sealing apparatus 110 may be mounted on a mandrel (such as the mandrel 40 described above), such as a tubular mandrel, and deployed into a wellbore to a desired location. The cup sealing element 114 may then be radially extended, for example by action of downhole fluid flow and/or pressure, to sealingly engage a bore wall, and establish a seal in an annulus defined between the mandrel and bore wall.

In this embodiment, it is notable that the sealing apparatus 110 includes a spring arrangement, generally represented by reference numeral 66, which in use biases the sealing apparatus 110 towards a retracted configuration and that the sealing apparatus 110 does not include a seal back-up assembly. However, it will be recognised that alternative embodiments may be provided with both a spring arrangement, such as the spring arrangement 66, and a back-up assembly, such as the back-up assembly 16.

As shown in FIG. 9, the spring arrangement 66 includes an annular spring element 68 which extends around the sealing element 114 and which is interposed between the sealing element 114 and an upper end face 70 of the base ring 112, which in the illustrated embodiment is tapered or rounded. While in the illustrated embodiment, a single annular spring element 68 is provided which extends circumferentially around the sealing element 114, the spring arrangement 66 may in alternative embodiments include a plurality of annular or part-annular spring elements arranged axially or circumferentially.

As in the apparatus 10, the various components of the apparatus 110 may be manufactured from a readily millable material. For example, the base ring 112 may include aluminium or the like. Further, the cup sealing element 114 may include a rubber material, such as nitrile, polyurethane or the like. Further, in the illustrated embodiment, the spring element 68 includes a carbon steel spring element.

A lower axial end face 118 of the base ring 112 includes a plurality of radially extending slots 120 (four slots 120 are shown in the illustrated embodiment), circumferentially arranged (at 90 degrees relative to each other in the illustrated embodiment) around the axial end face 118. The slots 120 are each configured to receive a respective protrusion provided on or associated with a mandrel (such as the mandrel 40 described above), to permit the sealing apparatus 110 to be rotatably locked or fixed to the mandrel. The base ring 112, cup sealing element 114 are rotatably interlocked relative to each other. Accordingly, all components of the sealing apparatus 110 may be rotatably interlocked relative to a mandrel on which the sealing apparatus 110 is mounted. Such an arrangement may permit the apparatus 110 to be milled while in situ. That is, rotatably interlocking the components of the apparatus 110 relative to a mandrel may permit a suitable milling tool to effectively act on the sealing apparatus 110, without individual components being simply rotated, which may otherwise render the milling tool ineffective.

The base ring 112 defines a central bore 122 which facilitates mounting of the apparatus 110 on a mandrel. More specifically, the base ring 112 includes a first central bore region 122*a* which is defined by a first wall portion 124*a*, and a second central bore region 122*b* of smaller inner diameter and which is defined by a second, thicker wall portion 124*b*. The second central bore region 122*b* includes an annular groove 126 which, in use, accommodates an o-ring for sealing against an outer surface of a mandrel. The base ring 112 also includes an annular surface 128 which faces generally in an axial direction and defines a stepped interface profile between the first and second central bore regions 122*a*, 122*b*.

The cup sealing element 114 defines a central bore 130 which in use accommodates a mandrel therethrough. Further, the cup sealing element 114 includes a base or proximal region 114*a* which is received within the base ring 112, and a free or distal end region 114*b* which extends axially from one side of the base ring 112. More specifically, the proximal end region 114*a* of the cup sealing element 114 is received within the first central bore region 122*a* of the base ring 112 with a proximal end face 132 of said sealing element 114 being engaged against the annular surface 128 of the base ring 112. Accordingly, the annular surface 128 of the base ring may provide axial support to the cup sealing element 114, and the first wall portion 124*a* of the base ring 112 may provide circumferential support to the sealing element 114, specifically the proximal end region 114*a* of the sealing element 114.

Abutting surfaces of the base ring 112 and sealing element 114 may be bonded to each other, which may assist in providing a seal therebetween.

The base ring 112 and cup sealing element 114 are rotatably coupled together via a complementary interengaging profile defined at the interface between the annular surface 128 of the base ring 112 and the proximal end face 132 of the sealing element 114. Specifically, in the embodiment shown the annular surface 128 of the base ring 112 includes a plurality of circumferentially arranged radial slots 134, and the proximal end face 132 of the sealing element 114 includes a corresponding number of radial protrusions or ribs 136 which are received within the respective slots 134 (shown most clearly in FIG. 10).

The sealing apparatus 110 is assembled and operated in the same manner as the sealing apparatus 10 described above and it will be recognised that in each of the above described embodiments the rotatable connection or coupling between at least a portion of the cup sealing assembly and a mandrel on which the assembly is mounted may assist in facilitating or permitting the sealing apparatus to be millable or otherwise machined by a rotating apparatus or tool bit, when in situ, and in scenarios where removal of the sealing apparatus may not otherwise be possible in an efficient manner.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

The invention claimed is:

1. A downhole sealing apparatus comprising:

a cup sealing assembly defining a central bore to permit mounting on a mandrel, wherein at least a portion of the cup sealing assembly is configured to be rotatably coupled to the mandrel, wherein a portion of the cup sealing assembly defines a mandrel locking profile to permit rotational locking of at least a portion of the cup sealing assembly relative to the mandrel, and wherein the cup sealing assembly comprises at least first and second components, wherein at least one of:

the first and second components are rotatably secured to each other via complementary locking profiles, the first and second components are rotatably secured to each other via complementary locking profiles, the complementary locking profiles being geometrically formed to be rotatably interlocked relative to each other, the first and second separate components are rotatably secured to each other via complementary locking profiles, wherein the complementary locking profiles define complimentary castellated locking profiles, one of the first and second components comprises a locking projection, and the other of the first and second components comprises a locking slot or recess to receive the locking projection, such that interaction between the locking slot and projection facilitates rotational locking between the first and second components, one of the first and second components comprises a locking projection, and the other of the first and second components comprises a locking slot or recess to receive the locking projection, such that interaction between the locking slot and projection facilitates rotational locking between the first and second components, and wherein the locking slot defines a radially extending slot, and the locking projection defines a radially extending projection, and one of the first and second components comprises a plurality of locking projections, and the other of the first and second components comprises a plurality of locking slots, and wherein each slot is configured to receive at least one projection.

2. The apparatus according to claim 1, wherein at least a portion of the cup sealing assembly is configured to be sealingly engaged with the mandrel.

3. The apparatus according to claim 1, wherein a portion of the cup sealing assembly is rotatably coupled to the mandrel via a mechanical interlock therebetween.

4. The apparatus according to claim 1, wherein at least one of:

the mandrel locking profile is geometrically formed to engage and rotatably interlock with a complementary locking profile associated with the mandrel; and the mandrel locking profile defines a castellated mandrel locking profile.

5. The apparatus according to claim 1, wherein at least one of:

a portion of the cup sealing assembly comprises a locking projection to be received within a locking slot or recess associated with the mandrel; and a portion of the cup sealing assembly comprises a locking slot or recess to receive a locking projection associated with the mandrel.

6. The apparatus according to claim 5, wherein at least one of:

the locking slot defines a radially extending slot, and the locking projection defines a radially extending projection;

the locking slot extends radially from a circumferential surface of a portion of the cup sealing assembly;

the locking projection extends radially from a circumferential surface of a portion of the cup sealing assembly;

the locking slot extends axially from an axially facing surface of a portion of the cup sealing assembly; and the locking projection extends axially from an axially facing surface of a portion of the cup sealing assembly.

7. The apparatus according to claim 5, wherein one of:

a portion of the cup sealing assembly defines or comprises a plurality of the locking projections and/or the locking slots or recesses; and a portion of the cup sealing assembly defines or comprises a plurality of the locking projections and/or the locking slots or recesses, and wherein at least two locking projections and/or at least two locking slots are circumferentially arranged and separated from each other on a portion of the cup sealing assembly.

8. The apparatus according to claim 1, comprising a clamping member configured to clamp a portion of the cup sealing assembly to the mandrel.

9. The apparatus according to claim 1, wherein the cup sealing assembly comprises multiple components, and wherein at least one of said components is configured to be rotatably coupled to the mandrel.

10. The apparatus according to claim 1, wherein the first component of the cup sealing assembly defines a seal support member defining a central bore to permit mounting on the mandrel, and the second component of the cup sealing assembly defines a cup sealing element mounted relative to the seal support member, wherein the cup sealing element defines a central bore to accommodate the mandrel therethrough.

11. The apparatus according to claim 10, wherein at least one of:

the seal support member is configured to be rotatably coupled to the mandrel;

the cup sealing element and the seal support member are rotatably secured to each other via a mechanical interlocking arrangement;

the cup sealing element and the seal support member are rotatably secured to each other via complementary locking profiles to permit the cup sealing element to be rotatably fixed to the seal support member;

a proximal end region of the cup sealing element is mounted on the seal support member, and an opposite distal or free end region of the cup sealing element extends axially from the seal support member;

the proximal end region of the cup sealing element comprises a locking profile configured to cooperate with a corresponding locking profile of the seal support member;

the proximal end region of the cup sealing element is mounted within the central bore of the seal support member;

at least a portion of the seal support member is radially expandable;

a portion of the seal support member which circumscribes the cup sealing element is radially expandable; and a portion of the seal support member which circumscribes the cup sealing element is radially expandable and at least a portion of the seal support member is plastically deformable in response to fluid pressure.

12. The apparatus according to claim 10, wherein the seal support member defines a first central bore region and a second central bore region, wherein the first central bore region defines a larger inner diameter than the second central bore region.

13. The apparatus according to claim 12, wherein at least one of:

the cup sealing element is mounted within the first central bore region of the seal support member, and the second central bore region permits mounting of the apparatus on the mandrel;

the seal support member includes an interface profile between the first and second central bore regions, and wherein the interface profile defines an annular surface;

the seal support member includes an interface profile between the first and second central bore regions, and wherein the interface profile is engaged by an axial end face of the cup sealing element;

the seal support member includes an interface profile between the first and second central bore regions, and wherein the interface profile comprises a locking profile configured to cooperate with a corresponding locking profile of the cup sealing element;

the first central bore region of the seal support member is radially expandable;

the first central bore region of the seal support member is radially expandable and plastically deformable; and the cup sealing element comprises a lip structure which facilitates axial clamping of the cup sealing element to the seal support member.

14. The apparatus according to claim 1, comprising a seal back-up assembly.

15. The apparatus according to claim 14, wherein at least one of:

the seal back-up assembly is configured to be rotatably coupled relative to a mandrel;

the seal back-up assembly is rotatably coupled to the cup sealing assembly;

the seal back-up assembly is radially expandable; and the seal back-up assembly is plastically deformable.

16. The apparatus according to claim 1, comprising a spring arrangement.

17. The apparatus according to claim 16, wherein the spring arrangement is configured to bias the sealing element towards a retracted configuration.

18. The apparatus according to claim 16, wherein at least one of:

the spring arrangement comprises a spring element;

the spring arrangement comprises a carbon steel spring element;

the spring arrangement comprises an annular or part-annular spring element;

the spring arrangement comprises a spring element interposed between the sealing element and an end ring;

the spring arrangement comprises a plurality of spring elements;

the spring arrangement comprises a plurality of spring elements, at least two of the spring elements arranged circumferentially; and the spring arrangement comprises a plurality of spring elements, at least two of the spring elements arranged axially.

19. A downhole scaling apparatus comprising:

a cup sealing assembly defining a central bore to permit mounting on a mandrel, wherein at least a portion of the cup sealing assembly is configured to be rotatably coupled to the mandrel, wherein a portion of the cup sealing assembly defines a mandrel locking profile to permit rotational locking of at least a portion of the cup sealing assembly relative to the mandrel, and wherein the cup sealing assembly comprises at least first and second components, the first and second components rotatably secured to each other via complementary locking profiles, wherein at least one of:

the first component is rotatably coupled to the mandrel, and the second component is rotatably coupled to the first component; and the apparatus comprises a mechanical interlock between the first and second components to provide a rotatable coupling therebetween.

20. A method for establishing a downhole seal, comprising:

locating a mandrel carrying a downhole sealing apparatus within a wellbore, wherein the downhole sealing apparatus includes:

a cup sealing assembly defining a central bore to permit mounting on a mandrel, wherein at least a portion of the cup sealing assembly is configured to be rotatably coupled to the mandrel, wherein a portion of the cup sealing assembly defines a mandrel locking profile to permit rotational locking of at least a portion of the cup sealing assembly relative to the mandrel, and wherein the cup sealing assembly comprises at least first and second components, wherein at least one of:

the first and second components are rotatably secured to each other via complementary locking profiles, the first and second components are rotatably secured to each other via complementary locking profiles, the complementary locking profiles being geometrically formed to be rotatably interlocked relative to each other, the first and second separate components are rotatably secured to each other via complementary locking profiles wherein the complementary locking profiles define complimentary castellated locking profiles, one of the first and second components comprises a locking projection, and the other of the first and second components comprises a locking slot or recess to receive the locking projection, such that interaction between the locking slot and projection facilitates rotational locking between the first and second components, one of the first and second components comprises a locking projection, and the other of the first and second components comprises a locking slot or recess to receive the locking projection, such that interaction between the locking slot and projection facilitates rotational locking between the first and second components, and wherein the locking slot defines a radially extending slot, and the locking projection defines a radially extending projection, and one of the first and second components comprises a plurality of locking projections, and the other of the first and second components comprises a plurality of locking slots, and wherein each slot is configured to receive at least one projection; and establishing a seal against a wall of the wellbore.

21. A downhole cementing apparatus comprising:

a tubular body; and a sealing apparatus mounted on the tubular body, wherein the sealing apparatus is rotatably connected to the tubular body, wherein the sealing apparatus includes a cup scaling assembly defining a central bore to permit mounting on a mandrel, wherein at least a portion of the cup sealing assembly is configured to be rotatably coupled to the mandrel, wherein a portion of the cup sealing assembly defines a mandrel locking profile to permit rotational locking of at least a portion of the cup sealing assembly relative to the mandrel, and wherein the cup sealing assembly comprises at least first and second components wherein at least one of:

the first and second components are rotatably secured to each other via complementary locking profiles, the first and second components are rotatably secured to each other via complementary locking profiles, the complementary locking profiles being geometrically formed to be rotatably interlocked relative to each other, the first and second separate components are rotatably secured to each other via complementary locking profiles, wherein the complementary locking profiles define complimentary castellated locking profiles, one of the first and second components comprises a locking projection, and the other of the first and second components comprises a locking slot or recess to receive the locking projection, such that interaction between the locking slot and projection facilitates rotational locking between the first and second components, one of the first and second components comprises a locking projection, and the other of the first and second components comprises a locking slot or recess to receive the locking projection, such that interaction between the locking slot and projection facilitates rotational locking between the first and second components, and wherein the locking slot defines a radially extending slot, and the locking projection defines a radially extending projection, and one of the first and second components comprises a plurality of locking projections, and the other of the first and second components comprises a plurality of locking slots, and wherein each slot is configured to receive at least one projection.

22. A downhole sealing apparatus, comprising:

a seal support member defining a central bore to permit mounting on a mandrel; and a sealing element mounted on the seal support member and defining a central bore to accommodate a mandrel therethrough, wherein at least a portion of the seal support member is radially expandable, and a portion of the seal support member defines a mandrel locking profile to permit rotational locking of at least a portion of the seal support member relative to the mandrel, and wherein the seal support member comprises at least first and second components, wherein at least one of:

the first and second components rotatably secured to each other via complementary locking profiles, the first and second components are rotatably secured to each other via complementary locking profiles, the complementary locking profiles being geometrically formed to be rotatably interlocked relative to each other, the first and second separate components are rotatably secured to each other via complementary locking profiles, wherein the complementary locking profiles define complimentary castellated locking profiles, one of the first and second components comprises a locking projection, and the other of the first and second components comprises a locking slot or recess to receive the locking projection, such that interaction between the locking slot and projection facilitates rotational locking between the first and second components, one of the first and second components comprises a locking projection, and the other of the first and second components comprises a locking slot or recess to receive the locking projection, such that interaction between the locking slot and projection facilitates rotational locking between the first and second components, and wherein the locking slot defines a radially extending slot, and the locking projection defines a radially extending projection, and one of the first and second components comprises a plurality of locking projections, and the other of the first and second components comprises a plurality of locking slots, and wherein each slot is configured to receive at least one projection.

* * * * *